United States Patent [19]

Johnston

[11] 3,945,354

[45] Mar. 23, 1976

[54] EXHAUST PORT OF TWO CYCLE ENGINE

[75] Inventor: Mervyn B. Johnston, Greenwich, Conn.

[73] Assignee: Textron Inc., Providence, R.I.

[22] Filed: Aug. 9, 1973

[21] Appl. No.: 386,890

[52] U.S. Cl. ..... 123/65 P; 123/65 R; 123/73 A

[51] Int. Cl.[2] ..... F02B 25/14

[58] Field of Search ..... 123/65 EM, 65 P, 73 R, 123/73 A, 65 A, 65 PD, 73 BA

[56] References Cited

UNITED STATES PATENTS

| | | | |
|---|---|---|---|
| 960,797 | 6/1910 | Blair | 123/73 A |
| 990,974 | 5/1911 | Giles | 123/53 |
| 1,263,820 | 4/1918 | Tidman | 123/65 P |
| 1,518,983 | 12/1924 | Hyvernaud | 123/65 S |
| 3,240,194 | 3/1966 | Rychlik | 123/65 |

FOREIGN PATENTS OR APPLICATIONS

| | | | |
|---|---|---|---|
| 316,922 | 4/1918 | Germany | 123/65 |
| 578,648 | 6/1958 | Italy | 123/65 P |

*Primary Examiner*—Wendell E. Burns
*Assistant Examiner*—David D. Reynolds
*Attorney, Agent, or Firm*—Robert E. Burns; Emmanuel J. Lobato; Bruce L. Adams

[57] ABSTRACT

The exhaust port of a spark ignition two cycle engine has the general shape of an inverted T with a base portion and a narrower upwardly extending stem portion. The top of the base portion is approximately at the level of the top of the transfer port which admits fuel-air mixture to the engine cylinder. The top of the stem is from 20° to 55° of crankshaft rotation in advance of the opening of the transfer port. This configuration of the exhaust port produces a low broad blowdown pulse which in turn results in a low noise level of the exhaust.

8 Claims, 4 Drawing Figures

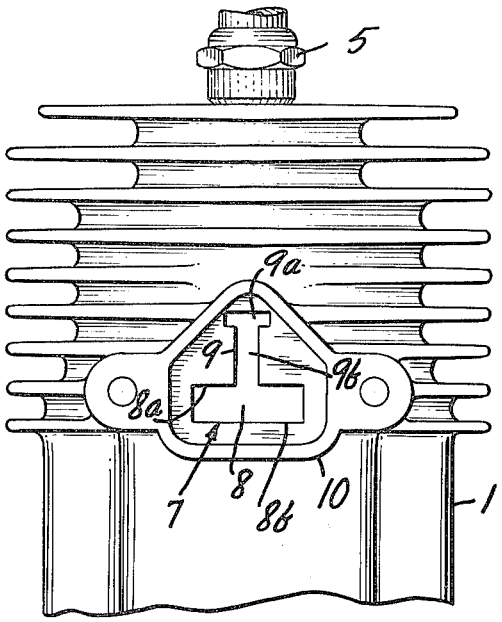
FIG. 1
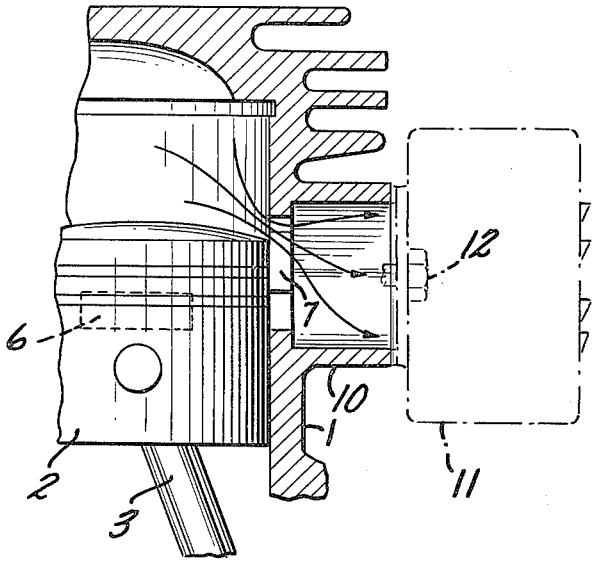
FIG. 2
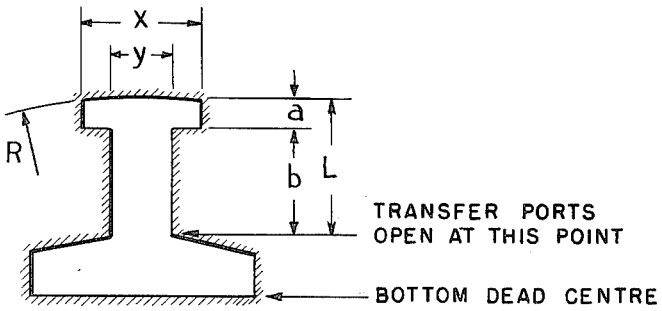
FIG. 3
| L | a | b | x | y |
|---|---|---|---|---|
| 55° | 6° | 49° | 5.5% | 5.5% |
| 45° | 6° | 39° | 10.5% | 10.5% |
| 35° | 6° | 29° | 22.0% | 14.0% |
| 25° | 6° | 19° | 32.0% | 19.0% |
| 20° – 55° | 0°–15° | 10°–55° | 5%–35% | 5%–30% |
FIG. 4

EXHAUST PORT OF TWO CYCLE ENGINE

FIELD OF INVENTION

The present invention relates to spark ignition two cycle internal combustion engines and is particularly concerned with obtaining the best balance between exhaust noise and power output of two cycle engines of the kind used for chain saws and other power tools, lawn mowers, snowmobiles, etc.

BACKGROUND OF INVENTION

The exhaust noise produced by two cycle engines presents a serious and difficult problem. The exhaust noise problem has become even more serious in recent years with the development of high compression, high performance and high speed engines. By reason of increased cylinder pressure the "blowdown" pulse that occurs upon opening of the exhaust port of the engine has become sharper and of greater amplitude thereby increasing the noise level of the exhaust. When used in populated areas the noise of small two cycle engines has become particularly objectionable. Moreover, it is of such a high level that permanent ear damage may be caused. Legislation has been enacted in some countries and is being considered in others to place a legal limit on the noise level of internal combustion engines.

Heretofore efforts have been made to decrease the exhaust noise of internal combustion engines by designing more effective mufflers attached to the exhaust passages of the engines. However, this approach has its limitations. In general, a more effective muffler decreases the power output of the engine by impeding the flow of exhaust gases and thereby building up a back pressure. Moreover, with hand held power implements such as chain saws, the attenuation of exhaust noise presents further problems by reason of space, weight and cost factors. In small engines such as those used on such hand held implements, space and weight are at a premium by reason of a continued effort to make the engines as small and light as possible. In order effectively to attenuate the exhaust noise of such an engine, a muffler might be as large as the rest of the engine, and weigh almost as much. Moreover, as chain saws and other power operated implements are highly competitive the additional cost involved in manufacturing a highly effective muffler is undesirable from the point of view of production costs.

SUMMARY OF INVENTION

It is an object of the present invention to obtain the best balance between exhaust noise reduction and power output of a two cycle engine while at the same time avoiding weight, volume and cost penalties. In obtaining this object the invention proceeds on a line of approach entirely different from that heretofore followed. Instead of seeking to attenuate the noise produced by the engine exhaust by means of a more effective muffler, the invention achieves a significant reduction in the exhaust noise produced by the engine by optimizing the shape of the exhaust port. By reason of this reduction in the exhaust noise produced by the engine, it is possible to use a small, light and inexpensive muffler and yet obtain acceptable sound levels.

In a two cycle engine a fuel air mixture is customarily precompressed, for example in the crankcase of the engine and is admitted to the cylinder through a transfer port when the piston is near the bottom of its stroke.

The fuel air mixture is then compressed in the cylinder by the upstroke of the piston and is ignited by a spark plug when the piston is near the top of its stroke. On the following downstroke of the piston the gaseous combustion products are discharged through an exhaust port before the piston reaches the bottom of its stroke. The transfer port and exhaust port are opened and closed by the piston sequentially in its reciprocatory movement. The transfer port customarily opens when the piston is at a level corresponding to approximately 125° of crank shaft movement after top dead center. The opening of the exhaust port has heretofore customarily been approximately 15° to 20° in advance of the opening of the transfer port.

Heretofore, the exhaust port has customarily had a rectangular or oval shape. With a rectangular or oval exhaust port, it has been found that when the exhaust port opens there is a sharp high amplitude blowdown pulse which results in a high level of exhaust noise.

In accordance with the present invention, the exhaust port instead of being rectangular or oval as heretofore, has the shape of an inverted T with a wider base portion and a narrower upwardly extending stem portion. The top of the base portion of the exhaust port opening is approximately at the level of the top of the transfer port. The stem portion extends upwardly from the base portion so that the opening of the exhaust port leads the opening of the transfer port by approximately 20° to 55° of crank shaft movement. Thus, if the transfer port opens at 125° after top dead center the exhaust port opens between 70° and 105° after top dead center. While the stem portion may be of uniform width throughout its length it has been found desirable in some instances to vary the width of the stem by having a short initial portion which is wider or narrower than the rest of the stem.

It has been found that with an exhaust port in accordance with the present invention it is possible materially to reduce the amplitude of the blowdown pulse and thereby reduce the exhaust noise level without serious loss of power of other detrimental effects on engine operation. This makes it possible to obtain an acceptable exhaust noise level with only a simple and inexpensive muffler.

While the invention is applicable in general to internal combustion engines in which the exhaust port is opened by being uncovered by the piston in its downward movement, it is particularly of value as applied to small two cycle engines operating at speeds up to 8000 or 9000 rpm and having a specific power output of 0.6 to 1.5 bhp/in$^3$ at 7000 rpm.

The nature, objects and advantages of the invention will appear more fully from the following description in conjunction with the accompanying drawing which illustrates by way of example a preferred embodiment of the invention.

IN THE DRAWINGS

FIG. 1 is a side view of a portion of the cylinder of a two cycle internal combustion engine having an exhaust port in accordance with the present invention;

FIG. 2 is a partial radial section of the engine cylinder shown in FIG. 1 and includes a portion of the piston;

FIG. 3 is a schematic illustration of the shape of an exhaust port in accordance with the invention identifying several dimensions of the exhaust port; and FIG. 4 is a tabulation of representative values of relative dimensions of an exhaust port in accordance with the invention as illustrated in FIG. 3.

DESCRIPTION OF PREFERRED EMBODIMENT

In FIG. 1 there is shown a portion of a cylinder 1 of a spark ignition two cycle internal combustion engine having an exhaust port in accordance with the invention. FIG. 2 shows a piston 2 which is reciprocable in the cylinder 1 and is connected to the engine crank shaft by a connecting rod 3. As the engine is in accordance with known construction except for the exhaust port, other portions of the engine are not shown. The cylinder is provided with a customary spark plug 5 and with a transfer port of which the level of its upper edge is indicated by a broken line 6. The transfer port is located for example so as to be uncovered by the piston and thereby open approximately 125° of crank shaft movement after top dead center. The engine cylinder is further provided with an exhaust port 7 which is formed in the wall of the cylinder and discharges into an exhaust passage 10 formed integrally with the cylinder. In FIG. 2 a muffler 11 of known construction is shown secured to the cylinder by stud bolts 12 so as to receive exhaust gases from the passage 10.

In accordance with the present invention the exhaust port 7 has the general shape of an inverted T with a wider base portion 8 and a narrower upwardly extending stem portion 9. The base portion 8 has an upper edge 8*a* and a lower edge 8*b*. The upper edge 8*a* is located approximately at the level of the upper edge of the transfer ports 6 one of which is indicated in dotted lines in FIG. 2. The lower edge 8*b* of the base portion of the exhaust port is approximately at the level of bottom dead center of the piston. The width of the base portion 8 of the exhaust port is sufficient to permit completion of blowdown and the purging of the cylinder by the incoming fuel air mixture admitted through the transfer port.

The upper edge of the base portion 8 of the exhaust port can be horizontal as shown in FIG. 1 or sloping as shown in FIG. 3. When the upper edge of the base portion of the exhaust port is inclined, the angle of inclination is preferably about 10° to the horizontal.

The stem portion 9 of the exhaust port extends upwardly from the base portion a distance corresponding to about 20° to 55° of crank shaft rotation in advance of the opening of the transfer port. If the height of the stem portion is too great, i.e., if the exhaust port opens too early, there is a loss in brake horsepower due to a leakage of charge on the upstroke of the piston. If the stem portion of the exhaust port is too short it must be made wider in order to provide sufficient blowdown before the base portion of the exhaust port is reached and this results in an increase in the exhaust noise level. It has been found that best results in attaining a balance of power and noise level are obtained when the stem portion of the exhaust portion has a length corresponding to 35° to 45° of crank shaft movement. Thus, when the transfer port opens at 125° after top dead center, the opening of the exhaust port occurs between 80° and 90° after top dead center.

The width of the stem portion of the exhaust port is selected to provide an area sufficient to permit proper blowdown of the cylinder before the top of the piston reaches the top of the base portion of the exhaust port. If the stem portion of the exhaust port is too narrow, the cylinder is "underblowdowned" with the result that overheating of the engine occurs. The overheating may be sufficiently severe to burn out the spark plug or to cause the piston to seize. If the stem portion of the exhaust port is too wide, the cylinder is "overblowdowned" with a resultant drop in brake horsepower and an increase in the sound level. Expressed in terms of a percentage of the cylinder diameter the width of the stem portion should be between 5 and 30 percent.

As illustrated in FIGS. 1 and 3 the stem portion of the exhaust port has an upper portion 9*a* and a lower portion 9*b* which may be of different widths and lengths. The length of the upper portion is preferably between 0° and 15° of crank shaft rotation. The width of the upper portion of the stem expressed in terms of percentage of the cylinder diameter is preferably between 5 and 35 percent. In some instances it may be desirable for the upper section 9*a* of the stem portion of the exhaust port to be wider than the lower section as illustrated in the drawings, while in others it may be of the same width or narrower according to the particular engine characteristics.

In order to obtain a proper balance between exhaust noise and engine power, the values of the exhaust lead, the lengths of the stem portions 9*a* and 9*b* and the widths of the stem portions should be within the limits set out in the last line of the table appearing in FIG. 4 in which:

L = lead of opening exhaust port before transfer port in degrees of crank shaft rotation.

$a$ = length of stem portion 9*a* in degrees of crank shaft rotation.

$b$ = length of stem portion 9*b* in degrees of crank shaft rotation.

$x$ = width of stem portion 9*a* in percent of cylinder diameter.

$y$ = width of stem portion 9*b* in percent of cylinder diameter.

In addition, these values should satisfy the following relationship:

$$800 \leq a \cdot x^{1.3} + b \cdot y + 20(L-20) \leq 1200$$

The values for preferred embodiments are given by way of example in the first four lines following the headings in the table of FIG. 4.

Using the values given in the table of FIG. 4, the aspect ratio of the stem portion of the exhaust port above the opening point of the transfer port (i.e. length divided by width) has the following values:

| Value of L | Aspect ratio |
|---|---|
| 45° | 2.7 |
| 35° | 0.95 |

As illustrated in FIG. 3 the aspect ratio of the stem portion of the exhaust port is approximately 1.1.

If desired, the top of the stem portion of the exhaust port may be curved as illustrated by way of example in FIG. 3 with a radius R between 25 percent of the cylinder diameter and infinity.

As the shape of the exhaust port is easily cast in the cylinder wall there is no material increase in the cost of production of the engine. Likewise, the pentagon shape of the exhaust passage 10 is easily cast and does not result in increased cost. By reason of the noise reduction attained by the shape of the exhaust port, it is possible to use a simple, small, lightweight and inexpensive muffler. It is thus possible in accordance with the present invention to achieve a marked reduction in the exhaust noise level without sacrifices of loss of power or increased manufacturing cost. The invention thus represents an important advance in the art.

While a preferred embodiment of the invention has been illustrated by way of example in the drawings and is herein particularly described, the invention is in no way limited to this embodiment. It will be recognized by those skilled in the art that many modifications in shape and size may be made while utilizing the teaching of the invention.

What I claim and desire to secure by Letters Patent is:

1. In a spark ignition two cycle internal combustion engine comprising a cylinder having a head, a crankshaft and a piston connected to said crankshaft and reciprocable in said cylinder, said cylinder having a single exhaust port and a transfer port successively uncovered by said piston to exhaust burned gasses from said cylinder and to admit a fresh charge of fuel-air mixture to said cylinder, the improvement that the exhaust port has the general shape of an inverted T with a wider base portion and a narrower stem portion extending upwardly toward the head of said cylinder, the bottom of said base portion being at bottom dead center of piston reciprocation, the top of said base portion being approximately at the level of the top of said transfer port and the top of said stem portion being from 20° to 55° in advance of the top of said transfer port, said stem portion comprising an upper section and a lower section of greater length than said upper section, the width of said exhaust port being approximately uniform throughout the length of said lower stem section to provide selected blowdown before the transfer port is opened and the width increasing abruptly at said base portion at approximately the level of the top of said transfer port to effect rapid lowering of cylinder pressure, the values of the width $x$ of said upper section of the stem portion and width $y$ of said lower section both expressed as percentages of the internal diameter of the cylinder, and the values of the length $a$ of said upper section, the length $b$ of said lower section and the lead L of the exhaust port opening over transfer port opening, all three expressed in degrees of crank shaft rotation being within the following ranges:

$a = 0° - 15°$ $b = 10° - 55°$ $x = 5 - 35$ percent $y = 5 - 30$ percent $L = 20° - 55°$ and satisfying the following relationship:

$$800 \leq a \cdot x^{1.3} + b \cdot y + 20(L-20) \leq 1200,$$

whereby the engine when running produces a low broad blowdown pulse which in turn produces a low noise level exhaust.

2. The improvement in a two cycle internal combustion engine according to claim 1, in which the values of said $a$, $b$, $x$, $y$ and L are in accordance with the following table:

| L | a | b | x | y |
|---|---|---|---|---|
| 55° | 6° | 49° | 5.5% | 5.5% |
| 45° | 6° | 39° | 10.5% | 10.5% |
| 35° | 6° | 29° | 22% | 14% |
| 25° | 6° | 19° | 32% | 19% |

3. The improvement in a two cycle internal combustion engine according to claim 1, in which the edges defining the top of said base portion are inclined at an angle of about 10° to a plane perpendicular to the cylinder axis.

4. The improvement in a two cycle internal combustion engine according to claim 1, in which said upper section of the stem portion of the exhaust port is approximately as wide as said lower section.

5. The improvement in a two cycle internal combustion engine according to claim 1, in which the length of the stem portion of the exhaust port corresponds to 35° to 45° of crankshaft rotation and in which the aspect ratio (length/width) of said stem portion is at least approximately 1.

6. The improvement in a two cycle internal combustion engine according to claim 5, in which the opening of the exhaust port occurs between 80° and 90° of crankshaft rotation after top dead center.

7. The improvement in a two cycle internal combustion engine according to claim 5, in which the width of said lower section of the stem portion of the exhaust port is between 5% and 30% of the cylinder diameter.

8. The improvement in a two cycle internal combustion engine according to claim 1, in which said transfer port is positioned to be opened by being uncovered by said piston at approximately 125° of crankshaft rotation after top dead center of piston reciprocation.

* * * * *